United States Patent [19]

Vanderwal, Jr.

[11] 4,397,658

[45] Aug. 9, 1983

[54] FEED CONTROL MEANS FOR HONING AND LIKE MACHINES

[75] Inventor: Frank E. Vanderwal, Jr., Frontenac, Mo.

[73] Assignee: Sunnen Products Company, St. Louis, Mo.

[21] Appl. No.: 291,173

[22] Filed: Aug. 10, 1981

Related U.S. Application Data

[63] Continuation of Ser. No. 81,623, Oct. 4, 1979, abandoned.

[51] Int. Cl.[3] ..... B24B 33/02

[52] U.S. Cl. ..... 51/72 R; 51/165.93; 51/338; 51/349; 51/352; 74/2; 74/512

[58] Field of Search ..... 51/34 H, 34 J, 32 R, 51/126, 165.84, 165.85, 165.79, 165.93, 332, 338, 349, 34 R, 32, 352-354; 74/2, 512

[56] References Cited

U.S. PATENT DOCUMENTS

| | | | |
|---|---|---|---|
| 2,195,055 | 3/1940 | Wallace | 51/338 |
| 2,309,485 | 1/1943 | Wallace | 51/338 |
| 2,377,588 | 6/1945 | Sunnen | 51/338 |
| 2,440,464 | 4/1948 | Ewaldson | 51/165.79 |
| 3,152,424 | 11/1964 | Sunnen | 51/72 R |
| 3,868,007 | 2/1975 | Sunnen | 74/2 |
| 3,896,591 | 7/1975 | Ruble | 51/126 |
| 4,035,959 | 7/1977 | Vanderwal, Jr. | 51/349 |

FOREIGN PATENT DOCUMENTS

| | | | |
|---|---|---|---|
| 408761 | 8/1974 | U.S.S.R. | 51/338 |

*Primary Examiner*—Stephen G. Kunin
*Assistant Examiner*—K. Bradford Adolphson
*Attorney, Agent, or Firm*—Haverstock, Garrett & Roberts

[57] ABSTRACT

An apparatus for controlling the application of feed motion to a working member in a machine such as a honing machine including a working member mounted on a support structure or mandrel and movable thereon into engagement with the work surface, mechanism movable to advance the working member under pressure into engagement with the work surface, and other mechanism to predeterminately control and limit the feed motion, independent of pressure, the other mechanism comprising a dash pot assembly having relatively movable portions one of which is pivotally attached to the machine and the other of which is axially movable relative thereto, a spring normally biasing the portions of the dash pot assembly together into a predetermined inoperative condition, cooperatively engageable cam and cam follower members including mounting structure therefor operatively engageable with the other portion of the dash pot assembly, a link member operatively connecting the cam follower member to the feed up mechanism on the machine that is used to movably advance the working member into engagement with the work surface, an operator actuatable member operatively connected to the cam and to the other portion of the dash pot assembly and movable when actuated to preset the cam and the dash pot assembly to predetermined positions at the beginning of each machine operation to control the feed of the working member against the work surface, and an adjustment mechanism operable to establish the distance over which the apparatus controls and restrains the application of feed to the working member, the dash pot assembly including an adjustment member operable to establish fluid flow between the relatively movable portions thereof.

12 Claims, 9 Drawing Figures

FEED CONTROL MEANS FOR HONING AND LIKE MACHINES

CROSS-REFERENCE TO RELATED APPLICATION

This application is a continuation of co-pending U.S. application Ser. No. 081,623, filed Oct. 4, 1979 and entitled FEED CONTROL MEANS FOR HONING AND LIKE MACHINES, abandoned after the filing hereof.

BACKGROUND AND SUMMARY OF THE INVENTION

In many machine tool operations the working member is moved into engagement with the work automatically and in some cases manually under control of means on the machine. This is true of honing machines that hone the surfaces of cylindrical bores. In such devices the work engaging member is a honing stone mounted for radial movement in a rotating mandrel. One of the usual ways to advance the stone radially to bring it into contact with the work surface is to move a wedge member axially under pressure during honing. The wedge member is so called because it has one or more beveled or cam surfaces which slideably cooperate with beveled surfaces on the stone assembly. Such means are well known and are disclosed in various patents, including Sunnen U.S. Pat. No. 3,152,424. This and other patents also disclose means which produce radial movement of the honing stone through the application of pressure thereagainst to effect movement of the stone against the work and which also control the amount of honing that takes place during each operation. Several problems exist with the known devices, however, including problems that result because of too rapid feed up of the stone into engagement with the work surface, the inability to control and limit, if necessary, the honing pressure during the entire honing operation, the inability to use relatively high honing pressure without damage, the inability to prevent parts rattle when the parts to be honed have relatively little stock to be removed resulting in damage to the parts and to the honing stones, and in the known devices there is no way to controllably restrain the automatic feed up of the abrasive member or stone in order to limit the rate of stone advance under pressure, when necessary, to prevent damage and otherwise. There is also no way in the known devices to easily shift between automatic and manual operation and at the same time overcome the shortcomings noted above. Furthermore, no known device combines the use of a feed up control with dash pot restraining means which can be accurately adjusted to regulate and limit the rate of feed up and to establish the range of control of the restraining means over the feed up. The present device can be used with existing feed up pressure control means including existing feed up means that control the honing pressure and the amount of honing to be done, and the present device modifies such means to enable improved operation and to enable the use of a much wider range of honing pressures, including relatively high honing pressures, to increase operating efficiency when honing parts regardless of the amount of stock removal required and with minimum chance for damage. The present means therefore constitute an important advantage in machine tool controls which enables broad adjustment, use of greater pressures, increased flexibility and enables honing machines to be adjusted to be more efficient in honing members, including members that require relatively little stock removal as well as members that require substantial stock removal.

OBJECTS

It is therefore a principal object of the present invention to provide greater control and adjustability over the feed up mechanism of a machine tool such as a honing machine.

Another object is to use hydraulic means in the control of the feed up of a work engaging member.

Another object is to increase the operating pressure that can be applied by a work engaging member during operation on a work surface without endangering or damaging any of the members involved.

Another object is to increase the efficiency of honing and like machines especially when operating automatically.

Another object is to enable a broader range of operating pressures to be used in machine tools so as to increase efficiency without increasing the risk for damage to the working members or to the work.

Another object is to controllably restrain the application of pressure between a working member and a workpiece.

Another object is to improve the operation and usefulness of machine tools such as honing machines without changing the basic machine construction and operation.

Another object is to provide an adjustable dash pot means for controlling and limiting the application of pressures applied by a feed up mechanism.

Another object is to teach the construction and operation of a dash pot assembly that requires no seal members between relatively movable parts.

Another object is to provide an hydraulic dash pot assembly with improved means for circulating fluid during operation thereof.

Another object is to increase the flexibility and versatility of machine tools.

These and other objects and advantages of the present invention will become apparent after considering the following detailed description of the preferred embodiments thereof in conjunction with the accompanying drawings, wherein:

DESCRIPTION OF PREFERRED EMBODIMENTS

Figure 1:
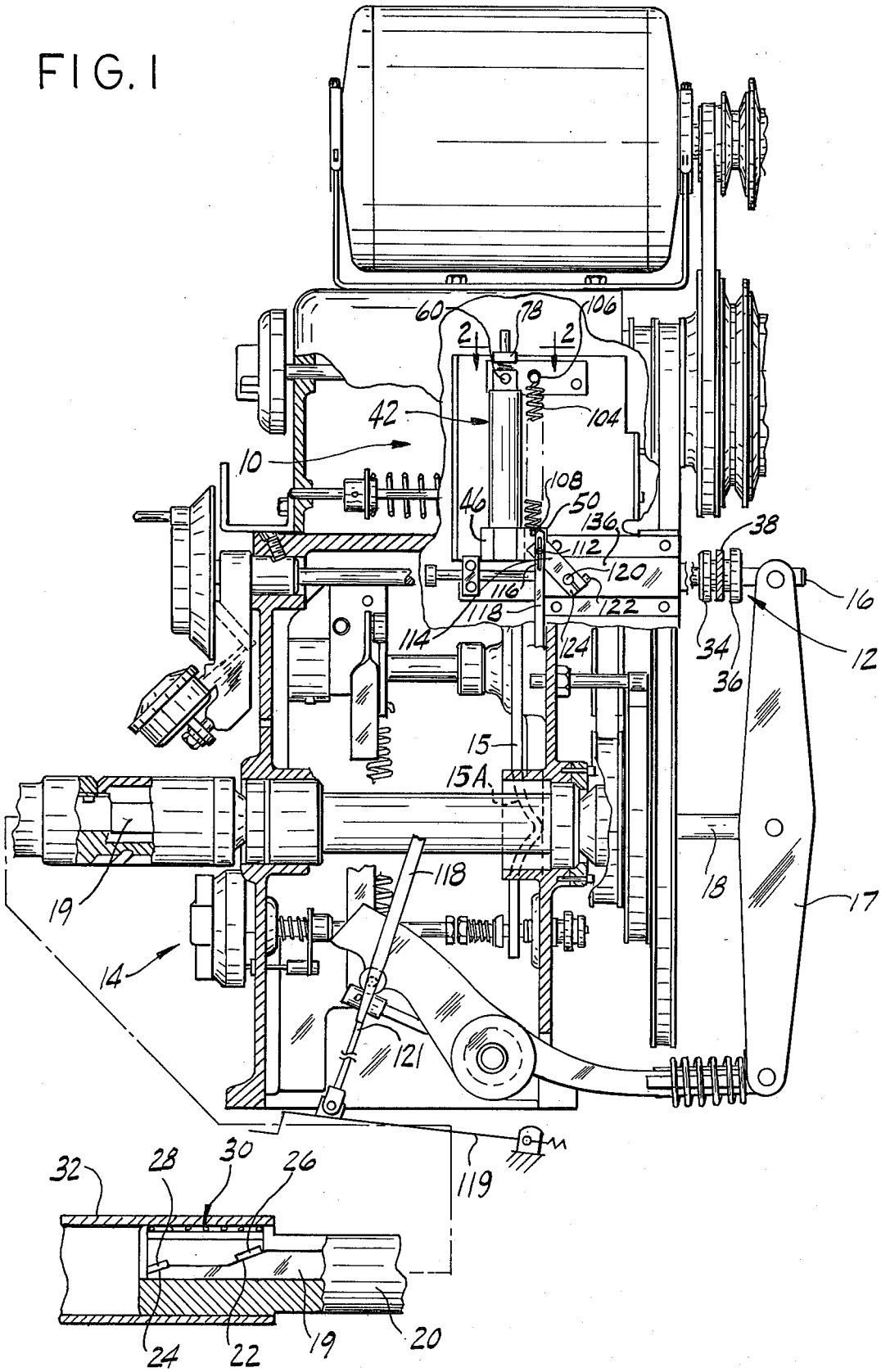
FIG. 1 is a side elevational view partly in section of a honing machine with feed up control means constructed according to the teachings of the present invention.
Figure 2:
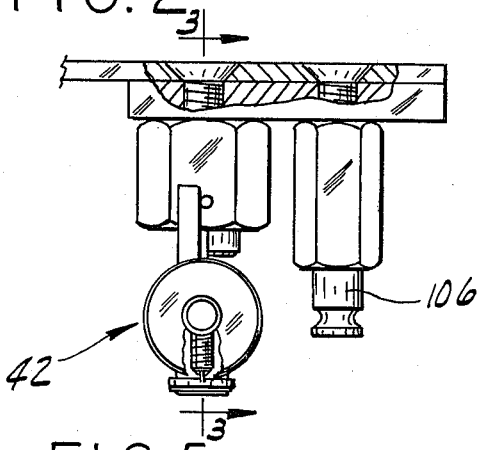
FIG. 2 is a fragmentary top plan view taken on line 2—2 of FIG. 1.

Referring to the drawings more particularly by reference numbers, number 10 refers to a feed up control device for controlling and restraining or limiting the feed up 12 on a machine tool such as on honing machine 14. The control 10 can be constructed as a relatively compact unit for installing on existing machines such as on the machine 14, or it can be made as original machine equipment. The present device is constructed to have an operative connection to a feed screw 16 which is the part of the machine that pressure is applied to to control the feed up of the work engaging member or honing stone as will be described. Pressure is applied to the feed screw by spring means such as by spring members 15 which is an elongated member that has a curved portion 15A that bears against the wall of the honing machine (See Sunnen U.S. Pat. No. 3,152,424). The pressure applied through the feed screw 16 to the honing assembly is adjustable both as to pressure and as to range of movement of the feed up over which the pressure is applied. The feed up including the feed up pressure is applied to the work engaging member through mechanisms on the honing machine including a feed arm assembly 17 and a feed rod 18 which is moved axially to apply axial force to a wedge member 19 that extends axially into honing mandrel 20. The wedge member makes sliding contact with the honing assembly and in so doing radially advances the honing assembly into engagement with the work surface or into a retracted condition. The portions of the honing machine 14 which are pertinent to an understanding of the subject device are shown in FIG. 1, which in large part is based on FIG. 2 of Sunnen U.S. Pat. No. 3,152,424 which issued Oct. 13, 1964. The description of the feed up mechanism and controls in the patented construction apply to the present invention and are incorporated herein by reference. It is important to understand that the construction and operation of the feed up and pressure control means of the patented construction are employed in a machine that incorporates the present device, but the operations of the known feed up means are modified by the present device to improve the operation thereof and to enable use of a wider range of honing pressures including especially higher honing pressures than can be used with the known devices. The present means can also be adjusted to operate over all or any desired portion of travel of the feed up means, and in so doing make honing more efficient and accurate and extend the life of the wear elements by preventing chatter and reducing damage.

Figure 4:
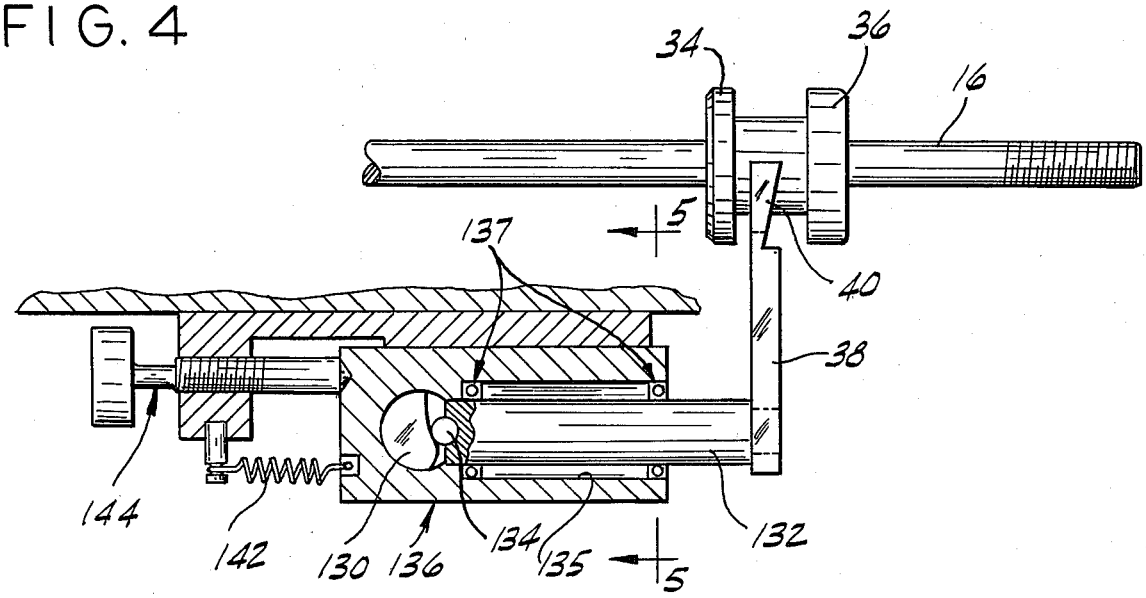
FIG. 4 is a top view partly in cross section of the cam and cam follower assembly and of the means for adjusting same employed in the present device.

The wedge member 19 has cam portions, such as cam portions 22 and 24 which slideably cooperate respectively with cam portions 26 and 28 on a honing stone assembly 30. The idea is to move the wedge 18 axially to thereby move the stone assembly 30 radially outwardly into honing engagement with a workpiece 32 during honing thereof. With the present means this can be done more rapidly and using higher honing pressures by controllably restraining the advance and range of wedge motion in a desired manner and over a desired portion of the feed up. The feed screw 16 operates in a known manner, as aforesaid, to produce the desired honing pressure and total amount of honing, and the feed screw 16 is provided with means including two spaced collars 34 and 36 which may be parts of a spool member that is positioned on the feed screw 16 at the locations shown. The present device includes an arm 38 which has a forked end portion 40 that extends into the space between the collars 34 and 36 for controlled engagement therewith as shown in FIGS. 1 and 4.

Figure 3:
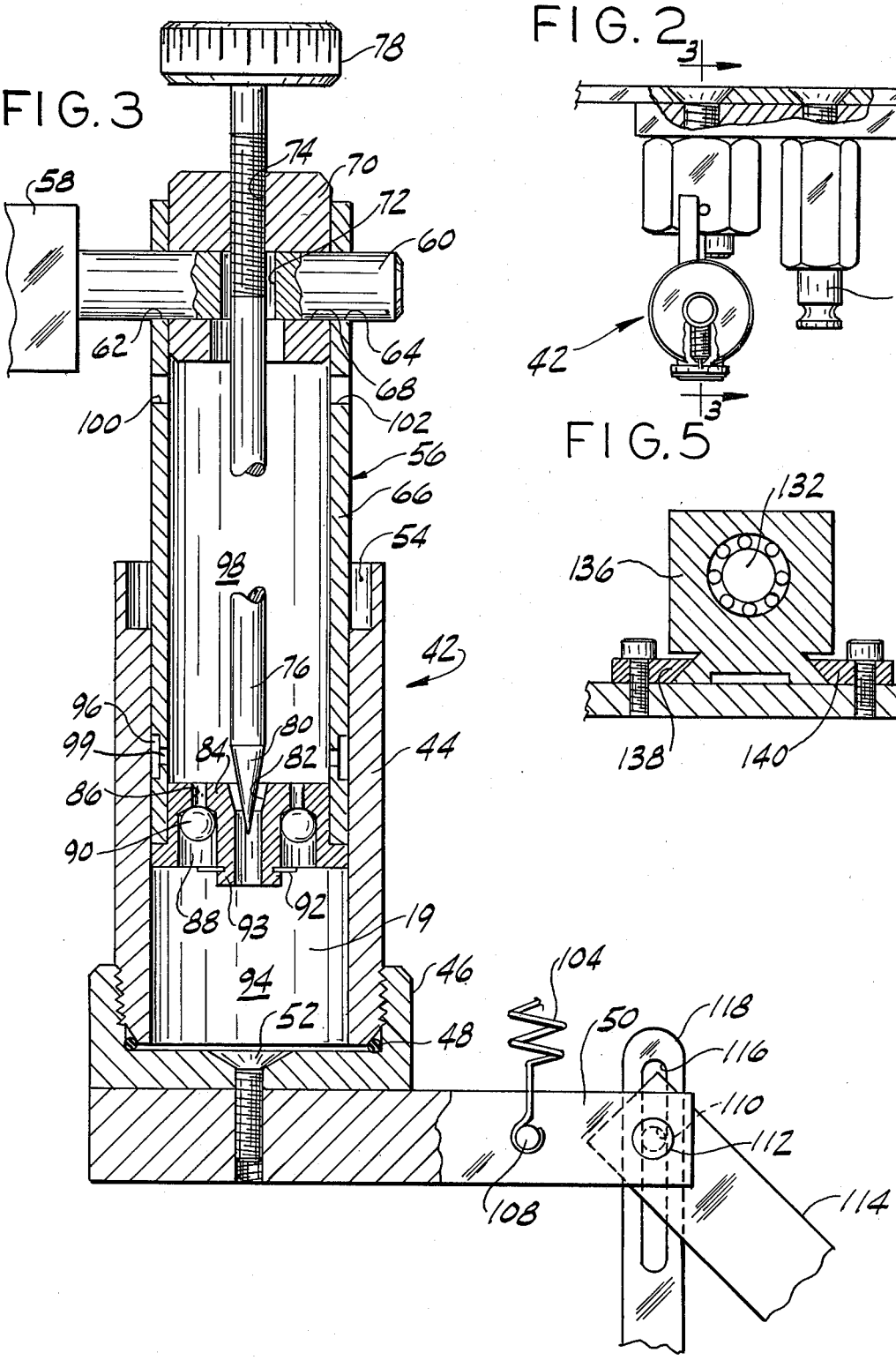
FIG. 3 is a cross-sectional view taken on line 3—3 of FIG. 2.

The object of the present device is to controllably move the arm 38 against the collar 36 in a direction to retard the movement thereof and of the wedge 18 which is under control thereof through the feed arm assembly 17 in order to controllably apply a pressure less than or equal to the preset wedge pressure to expand the honing diameter and maintain the stone assembly 30 engaged under pressure with the workpiece 32. In the present case, the retarding force is produced hydraulically by dash pot means 42 (FIGS. 1 and 3) which act through other means including cam means to apply the restraining force. The dash pot means 42 employed have a special construction which includes an outer cylinder portion 44 which is threadedly engaged with a lower cap member 46. "O" ring 48 provides an non-movable sealed connection therebetween. The cap 46 is fixedly con-connected to a lever 50 by threaded or other means such as by screw 52. The dash pot cylinder 44 is oriented substantially vertically, and its upper end is provided with an annular inside groove 54 which is an oil gathering groove, the purpose of which will become apparent.

A piston assembly 56 extends downwardly into the cylinder 44 and is pivotally supported on the machine base 58 by means of pivot shaft 60 which extends through aligned openings 62 and 64 in a tubular piston member 66, and through aligned openings 68 in a guide bushing member 70 which extends downwardly into the tubular piston 66 from the upper end. The pivot shaft 60 has a vertically oriented cross bore 72 therethrough, and the bushing 70 has an axially oriented threaded bore 74 therethrough which receives an adjustable needle valve member 76. The upper end of the needle valve 76 has a calibrated adjustment knob 78 attached thereto and is used to adjust the position of the needle valve 76, and particularly the opposite lower pointed end portion 80 thereof relative to an orifice such as orifice 82 which may have a tapered surface portion and is located in a piston closure member 84.

The closure member 84 has one or more other orifices therethrough such as the orifices 86 which communicate with respective chambers 88 in which ball valve members 90 are positioned. The ball valve members 90 are held in their respective chambers 88 by means of snap ring 92 which is mounted in a groove in an extension 93 of the closure member 84. During operation of the subject device, relatively high pressure is maintained in chamber 94 formed by and between the closure member 84 and the cylinder 44, and this high pressure causes the balls 90 to move upwardly closing their respective orifices 86 so that the position of the pointed end 80 of the needle valve 76 relative to the orifice 82 controls the rate at which the high pressure in the chamber 94 is relieved.

The outer surface of the piston 66 is accurately sized to the inner surface of the cylinder 44 so that relatively little leakage occurs therebetween. Any fluid or oil that is able to work itself between the members 44 and 66 helps to seal therebetween, and some of this oil moves upwardly between the members from the high pressure upper end of the needle valve 208 is slideably, not threadedly, positioned in a bore 219 in a piston support member 220, and the needle valve 208 has an upper end that is conical in shape at 221. The conical surface 221 cooperates with another conical surface 222 on an adjustment member 224 which is at right angles to the needle valve 208 and is threadedly positioned in a bore 226 in support member 228. The threaded adjustment member 224 has a knob portion 230 on the free end thereof that is rotated to adjust the positon of member 208 and particularly the pointed lower end 212 thereof relative to the orifice 214. With the construction shown in FIG. 7, it is possible to make and maintain precise adjustment of the needle valve member 208 in order to accurately control and restrain the applied honing pressure. The dash pot assembly 200 can be used with cam means and other means similar to those described above in connection with the embodiment of FIG. 1, and the dash pot 200 includes a spring 232 mounted as shown to apply pressure continuously to move the members together. The spring 232, working in concert with the metering action of needle valve member 208 in orifice 214, controls the rate at which the dash pot is restored.

Figure 8:
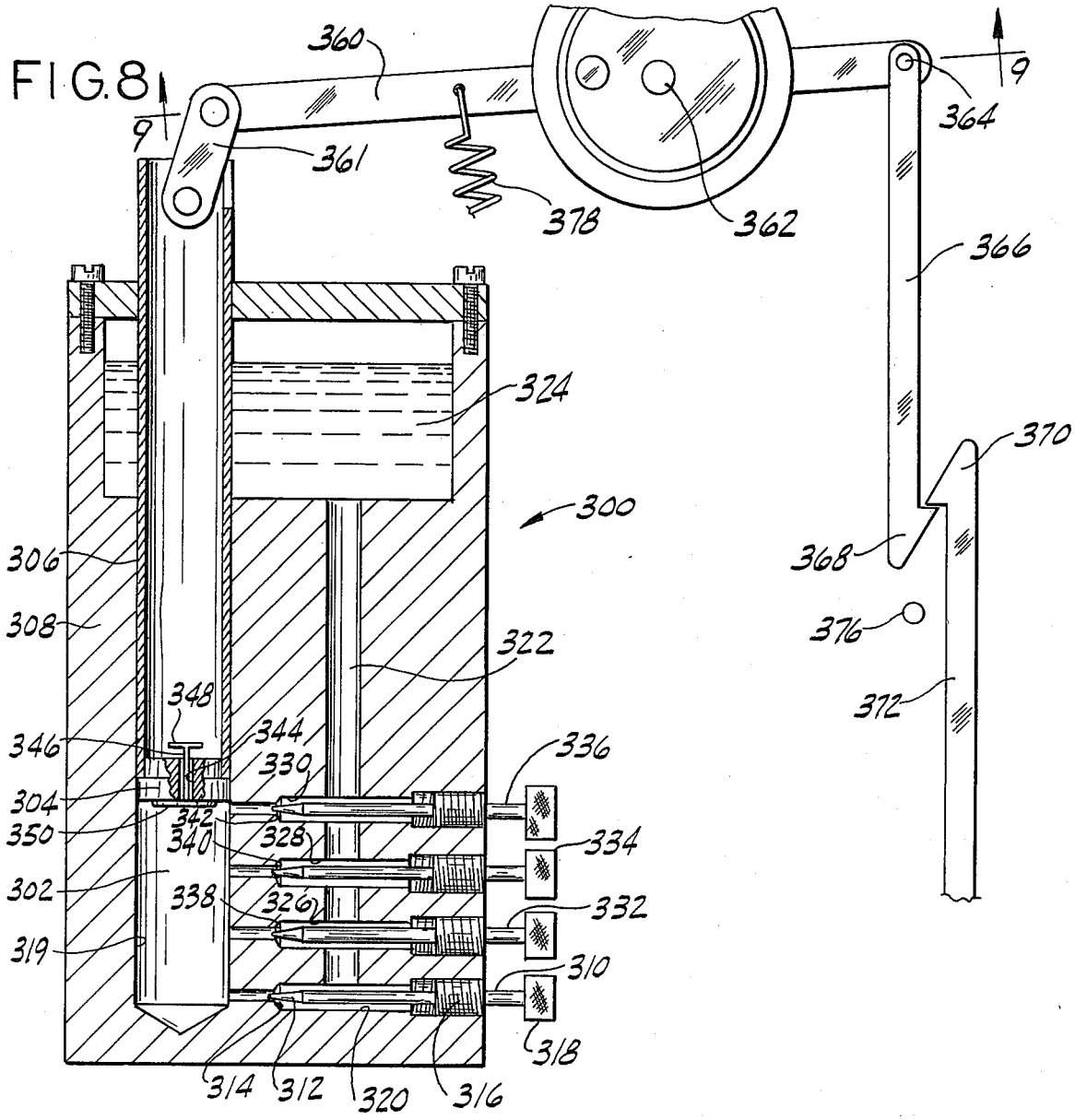
FIG. 8 shows another modified form of the dash pot assembly and of the controls for adjusting same.
Figure 9:
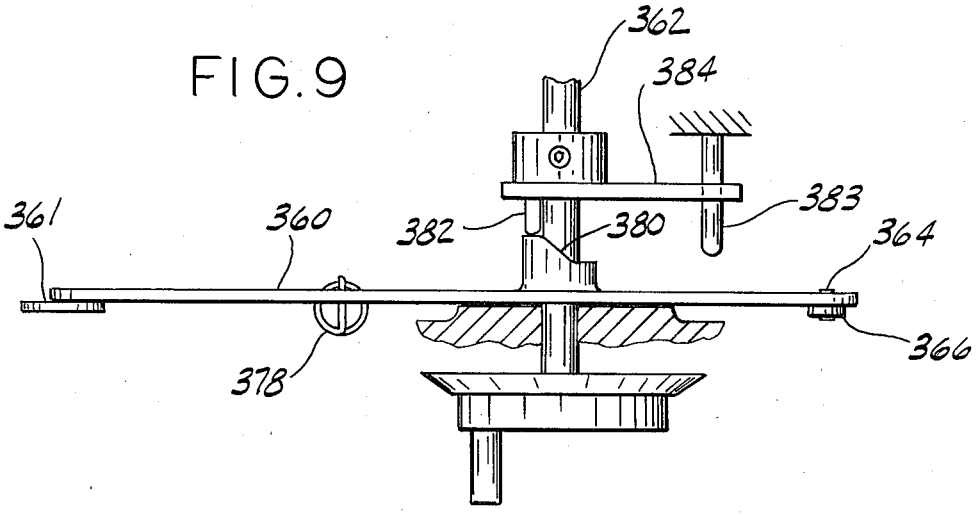
FIG. 9 is a top plan view of a portion of the dash pot assembly of FIG. 8, taken on line 9—9 of FIG. 8.

FIG. 8 shows another modified form 300 of the dash pot assembly wherein the high pressure space 302 formed between piston closure member 304 on the lower end of piston member 306 and the cylinder means in body 308 has a plurality of separately adjustable needle valves located at various elevations. The lowest needle valve 310 has a needle portion 312 which cooperates with a bore or orifice 314 that communicates with the high pressure chamber 302 from one side thereof. The needle valve 310 is threadedly positioned in the body 308 at 316 and has an adjustment knob 318 which can be rotated in either direction to adjust the space between the needle portion 312 and the orifice 314. The needle valve 310 provides the finely controlled restraining pressure when the piston 306 moves downwardly in body bore 319. The needle valve 310 extends through an enlarged bore portion 320 which communicates with a return manifold 322 that extends upwardly in the body 308 therefrom and communicates at its upper end with a reservoir 324 for the fluid contained in the device.

At other spaced locations above the lowest bore 320 in which the needle valve 310 is positioned are other similar spaced bores 326, 328, and 330, and other corresponding needle valves 332, 334, and 336 positioned in the respective bores 326, 328, and 330. Each of the needle valves is threadedly engaged with the body 308 so that they can be individually adjusted. The needle valve 332 cooperates with an orifice 338 which communicates with the high pressure chamber 302 at a location above the needle valve 310, the needle valve 334 cooperates with an orifice 340 which communicates with the high pressure chamber 302 at a still higher location, and the needle valve 336 cooperates with an orifice 342 that communicates at a still higher location with the high pressure chamber 302. Each of the needle valves 332, 334, and 336 can be individually adjusted to control the amount of flow permitted thereby.

The closure member 304 on the lower end of the piston 306 has a passage 344 therethrough which contains a one way valve that has a rod portion 346 with an enlarged upper portion 348 and a still larger bottom portion 350. When the piston 306 is moved upwardly in the body bore 319, the member 350 moves downwardly away from the closure member 304 permitting oil or other fluid to flow downwardly through the closure member 304 and into the high pressure chamber 302. Thereafter when the piston 306 moves downwardly in the bore 319, its rate of downward movement, and hence its retarding effect on the honing feed, will vary depending upon the position of the piston 306 and particularly of the closure member 304 relative to the orifices 314, 338, 340 and 342 for the respective needle valves 310, 332, 334 and 336. This means that during the downward movement of the piston 306, assuming the various needle valves are each adjusted to permit some fluid flow thereby, which is usually not necessarily the case, there will be less retarding force produced with faster rate of piston descent during the initial part of the downward movement because of the greater number of needle valves that are providing some control, and the retarding force will increase each time the closure member 304 moves past and blocks off another one of the needle valves during its downward movement. With the construction shown in FIG. 8 it is therefore possible to predeterminately control and vary the rate at which the honing stone 30 advances against the work surface. This is highly desirable and enables the initial portion of a honing operation, such as the feed up portion when the stone is moving into engagement with the work, to take place relatively more rapidly than the later portions when most of the honing takes place and when it is necessary that the stone advance more slowly. With this construction the retarding action increases in one or more steps reaching its maximum effect near final stages of the honing operation. This is especially desirable for certain types of honing operations including those where relatively small amounts of material are to be removed from the work during a honing operation, but where it is desirable for efficiency to bring the stone into engagement with the work relatively rapidly thereby reducing the amount of time required to hone each part.

The construction shown in FIG. 8 can be incorporated for use with the cam means and other features of constructions such as those described above but some modification will be required. If the dash pot assembly 300 is used instead of the dash pot assemblies described above, it is usually desirable to fixedly attach the larger body member 308 to the machine and to connect the upper end of the movable piston member to the foot pedal apparatus. When the foot pedal is depressed therefore the piston member 306 will be moved upwardly, rather than moving the cylinder portion downwardly as in the previous constructions, and this can be accomplished by using a device such as crank arm 360 which is pivoted to the machine at 362 which may be part of the feed screw 16. The crank arm 360 is coupled to the upper end of the piston 306 by a link 361, and can have another connection as illustrated by pivotal connection 364 to a hook member 366 which extends downwardly to a hook end portion 368 which engages a similar hooked end portion 370 on a member 372. The member 372 is pulled downwardly under control of the machine pedal mechanism. A spring 374 maintains engagement between the hook portions 368 and 370 until during downward movement the hook portions move into engagement with a release pin 376 which separates them enabling the members 360 and 366 to be restored to the inoperative position by the spring 378. As the arm 360 rotates about the feed screw 16, a cam surface 380 on the arm 360 moves a cam follower 382 on the feed screw 16, while pin 383, which is fixedly attached to the machine and extends through a hole in flange 384 of the chamber 94 and enters an annular space formed by annular groove 96 in the outer surface of the piston 66. The groove 96 communicates with the low pressure in piston chamber 98 above the closure member 84 through other ports 99 in the piston 66. The piston 66 is almost completely filled with fluid or oil, and some of the oil will also work its way between the members 44 and 66 above the groove 96 and move upwardly during relative movement between the dash pot members 44 and 66. This oil eventually accumulates in the annular groove 54 at the top of the cylinder 44, and drains back into the piston through other piston orifices such as piston orifices 100 and 102 which communicate the upper piston chamber 98 to atmosphere. This drainage occurs whenever the cylinder 44 is moved upwardly about the piston 66 to a position where the annular groove 54 registers with the orifices 100 and 102. This assures good lubrication between the piston 66 and the cylinder 44 and prevents loss of oil from the device.

Adjustment of the needle valve 76 by means of the knob 78 will meter flow of oil through the orifice 82 and hence will control the rate of movement of the piston 66 relative to the cylinder 44 during operation. The ability to be able to meter flow in this way is important because the force required to move the dash pot members together is also the force that is used to control or restrain and limit the rate of movement of the wedge member 19 due to the honing pressure applied thereto by the pressure applied on the feed screw 16. This is true regardless of the amount of honing pressure that is applied. This also means that a much wider range of honing pressures can be used than heretofore, including much higher pressures, and with much less likelihood for damage. The restraining pressure that makes this possible is produced by the dash pot assembly 42.

The dash pot 42 is also acted upon by a relatively heavy spring 104 which has its upper end anchored to the machine base by stud 106 and its lower end anchored to a pin 108 which is attached to the cap 46 on the lower end of the cylinder 44. During operation, when the operator steps on the foot pedal or otherwise actuates the device, the cylinder 44 is pulled downwardly during which time the oil in the piston 66 above the wall 84 drains into the lower chamber 94 through the orifice 86 past the ball valve 90 which are unseated at this time. Thereafter when the foot pedal is released the spring 104 operates to apply force to the cylinder 44 in the upward direction in opposition to the metering force produced by the needle valve 76. The force of the spring moves the ball valves 90 into their upward closed positions so that the metering effect of the needle valve 76 controls the rate at which the dash pot members can move relative to each other. The action of the spring 104 is in the direction of restoring the dash pot and this action is resisted by the pressure of the fluid in chamber 94. The rate at which the dash pot is restored is dependent on the position of the needle valve 76 relative to the orifice 82.

The lever 50, which is connected to the cylinder 44, has a cross bore 110 (FIG. 3) that receives a pin 112. The pin 112 cooperates with a cam lever 114, and has an end portion that slideably cooperates with an elongated groove 116 formed in a pull rod 118. The pull rod 118 provides the operative connection to pivotal pedal means 119 through rod 121 which, when actuated, pulls the rod 118 downwardly and in so doing, also pulls the cylinder 44 downwardly to cock the dash pot assembly 42 in readiness for a feed up operation. Actuation of the foot pedal also does other things to initiate a honing operation as explained for example in Sunnen U.S. Pat. Nos. 4,035,959 and 3,868,007. When the cylinder 44 moves downwardly, the cam lever 114 rotates in a counter clockwise direction (FIG. 1), and the dash pot assembly 42 pivots to the left about the pivot shaft 60 near its upper end to accommodate the rotation of the lever 114.

Figure 5:
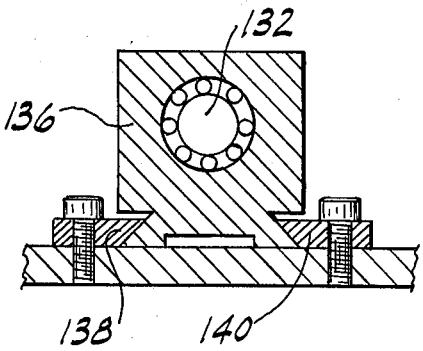
FIG. 5 is a cross-sectional view taken on line 5—5 of FIG. 4.
Figure 6:
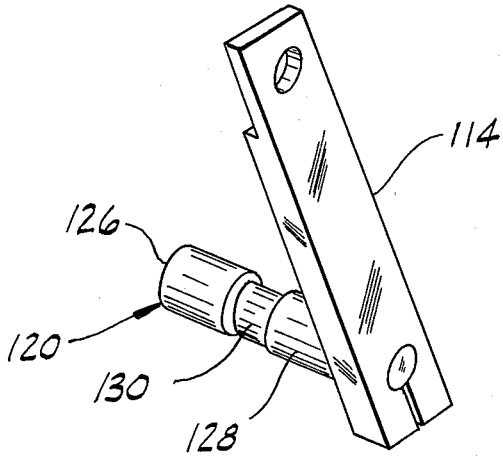
FIG. 6 is a perspective view of the cam shaft and cam lever assembly employed in the present device.

The cam lever 114 is fixedly connected to one end of a rotatable cam shaft 120 (FIG. 6) by means of a threaded member 122 (FIG. 1) which extends through aligned bores in a split end portion 124 of the lever 114. The cam shaft 120, as shown in FIG. 6, is formed by spaced cylindrical bearing portions 126 and 128 and a cam portion 130 therebetween. When the cam lever is pulled down by operation of the foot pedal, the cam shaft 120, including the cam portion 130, rotates to produce axial movement of a cam follower member 132 (FIG. 4). The cam follower 132 has a ball or other follower portion 134 on one end which engages and rides on the cam portion 130, and the cam follower is mounted for friction free axial movement in a bore 135 in block member 136 by means of spaced sets of bearing rollers 137. The block member 136 is mounted for axial adjustment on the fixed portion of the machine by dove tail connection means 138 and 140 (FIG. 5). The position of the block 136, and of the cam and cam follower members positioned therein, can be adjusted as desired to determine and control the position of the member 38 and the range of possible movement thereof, and hence the range over which the restraining action of the honing pressure is applied. This is an important feature taking into account the amount of honing that is to be done. The means for adjusting the position of the block 136 will be described.

The block 136 which houses the cam means is biased to the left as shown in FIG. 4 by spring 142, and the block is positionally adjustable in opposition to the spring 142 by means of threaded adjustment member 144 which when rotated repositions the block 136 along the dove tail connection means 138 and 140. The forked arm 38 which extends between and engages the collars 34 and 36 on the feed screw 16, as explained above, is connected to the free end of the cam follower 132. The position of the arm 38 relative to the coller 36, controls the range of free movement of the arm 38 and thereafter the range of movement when the arm 38 is engaged with the collar 36 to limit or restrain the rate of movement that can be applied by the feed screw 16 to the honing stone assembly 30. It can therefore be seen that the subject means provide a wide range of possible adjustment as to (1) how much feed up motion can occur without being restrained, (2) how much of the total feed up operation will be restrained, and as to (3) the rate of feed that is produced during the restrained portion of operation.

Figure 7:
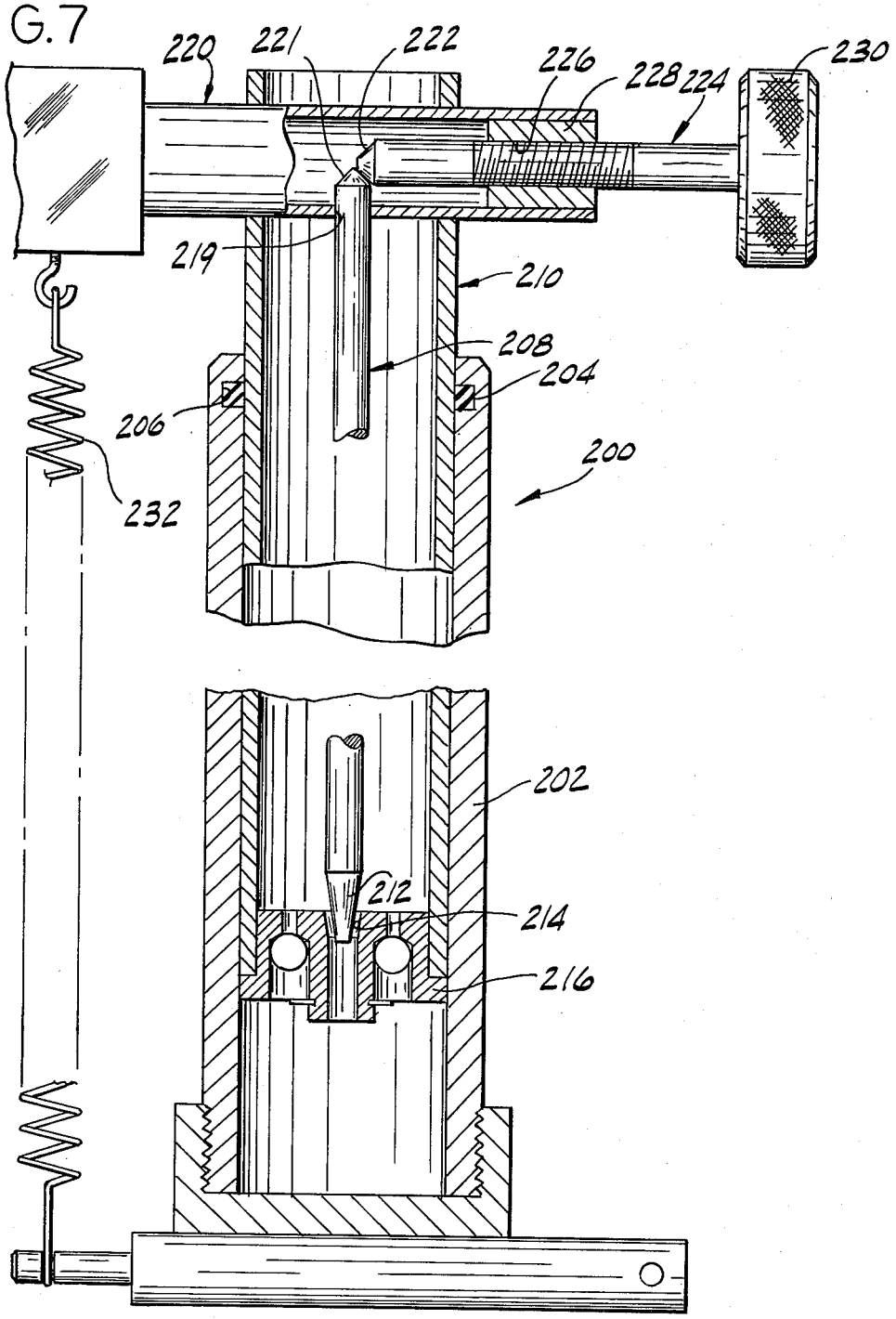
FIG. 7 is an enlarged cross-sectional view showing a modified form of means for adjusting the metering orifice employed in the dash pot assembly of the subject device.

FIG. 7 shows a modified form 200 of the subject dash pot assembly wherein cylinder portion 202 is similar in construction to the cylinder portion 44, but instead of having an annular oil collecting groove formed in its upper end, it has an annular seal or "O" ring 204 positioned in a groove 206. Also, in the modified construction 200, a different style needle valve 208 and needle valve control is used which includes a portion that extends upwardly in the piston member 210. The needle valve 208 has a pointed needle end portion 212 which cooperates with an opening or orifice 214 in a closure member 216 in the lower end of piston portion 210. The cam follower 382, prevents cam follower 382 from influencing or being influenced by feed screw 16 in a rotational manner, thus moving the feed screw in a rearward direction on the machine thereby preventing or releasing cutting action. In this case the dash pot controls rotation in the opposite direction to control the advancement of the honing stone against the work and provide control throughout the honing cycle.

In the construction shown in FIG. 8 the upper end of the piston 306, rather than the lower end of the cylinder, will be the part that is operatively connected to the feed screw to control the rate of advance of the honing stone. This construction may also include cam means similar to those described above in connection with FIG. 1, for example.

Thus there has been shown and described novel means for predeterminately controlling and restraining the rate of advance of the honing stone assembly or other machine tool part to enable the use of a wider range of operating conditions including relatively high pressures without damage to the parts involved and to increase the machine efficiency, which means fulfill all of the objects and advantages sought therefor. It will be apparent to those skilled in the art, however, that many changes, modifications, variations and other uses and applications for the subject means are possible and contemplated, and all such changes, modifications, variations and other uses and application which do not depart from the spirit and scope of the invention are deemed to be covered by the invention which is limited only by the claims which follow.

What is claimed is:

1. Means to predeterminately control and limit the rate of advance of a working member against a workpiece, including a workpiece having work surface thereon, a working member having a portion for engaging the work surface during operation thereon, and means to produce predetermined pressure by the working member against the work surface, the improvement comprising an hydraulic device having relatively movable first and second portions defining therebetween an expandable chamber for fluid, yieldable means urging the first and second portions to a predetermined inoperative condition, means to predeterminately meter escape of fluid from the chamber to control the force required to produce relative movement between the first and second portions, means pivotally anchoring said first relatively movable portion, means operatively connecting the second portion to the means for producing predetermined pressure by the working member against the work surface to restrain and limit the force that can be applied thereby and by the working member against the workpiece, said means operatively connecting the second portion including relatively movable cam and cam follower members, one of which is connected to said second portion and the other being operatively connected to the means for producing pressure, and operator actuatable means operatively connected to the second relatively movable portion of the hydraulic device and to the cam member, actuation of the operator actuatable means moving the second relatively movable portion relative to the first relatively movable portion in opposition to the yieldable means urging them to their predetermined inoperative condition and simultaneously working the cam member relative to the cam follower member, restoration of the cam member under control of the yieldable means controlling movement of the working member into engagement with the workpiece and restricting application of restraining force produced by the hydraulic device against the means to produce pressure by the working member against the workpiece.

2. The means defined in claim 1 including means to adjust the position of the cam and cam follower members relative to the means to produce pressure to establish the range over which the applied pressure is restrained and limited.

3. In a honing machine having a rotatable mandrel with a stone assembly mounted thereon and means to apply radial pressure to the stone assembly against a work surface during honing thereof including means to control the movement of the stone assembly into engagement with the work surface and the amount of pressure to be applied by the stone assembly against the work surface and means to control the amount of radial movement of the stone assembly during a honing operation, the improvement comprising means to restrain the rate of radial movement of the stone assembly against the work surface, and means to control the range over which the radial movement of the stone assembly is restrained, said restraining means including an hydraulic dash pot assembly having relatively movable piston and cylinder portions defining therebetween a substantially closed expandable chamber for containing a fluid, yieldable means urging the piston to a predetermined inoperative position in the cylinder portion, means to meter the escape of fluid from the chamber and the rate of relative movement between the piston and cylinder portions, said metering means including a port through one of said portions and a member positionally adjustable relative thereto, means to anchor one of said dash pot portions to the honing machine, means on the other dash pot portion engageable by the pressure applying means to controllably restrain application of pressure from the pressure applying means to the stone assembly, said means on the other dash pot portion including relatively movable cam and cam follower members one of which is operatively connected to the other dash pot portion and the other is engageable by the means for applying radial pressure to the stone assembly, and an operator actuatable pedal for simultaneously producing relative movement between the piston and cylinder portions of the dash pot assembly and relative movement between the cam and cam follower members both in opposition to the yieldable means to establish initial conditions for commencing a honing operation, restoration of the relative movement bewteen the cam and cam follower members during a honing operation controlling movement of the stone assembly into engagement with the work surface and application of the restraining force produced by the dash pot assembly against the force applied to the stone assembly by the means to apply radial pressure thereto.

4. In the honing machine of claim 3, means to adjust the position of the cam and cam follower members relative to the means for applying radial pressure to establish the range of movement of the pressure applying means which are subject to being restrained.

5. In the honing machine of claim 3, the dash pot assembly includes unidirectional valve means which are movable to an open position to permit relatively unrestricted movement between the piston and cylinder portions of the dash pot assembly in one direction, and a closed position wherein relative movement between the dash pot portions is controlled by the metering means.

6. In the honing machine of claim 3 the anchored portion of the dash pot assembly is the piston portion.

7. In the honing machine of claim 3 the anchored portion of the dash pot assembly is the cylinder portion.

8. In the honing machine of claim 7 wherein the cylinder portion has a plurality of vertically spaced fluid metering means communicating with the expandible chamber at spaced locations therealong.

9. A honing machine having a rotatable mandrel portion with a stone assembly for engaging a surface to be honed, means on the honing machine engageable with the stone assembly for moving the stone assembly radially outwardly into engagement with a work surface, means adjustable to control the amount of radial movement of the stone assembly during a honing operation, other means adjustable to apply radial outward pressure to the stone assembly during a honing operation, said means including a feed screw operatively coupled to the means for radially moving the stone assembly, the improvement comprising means operatively coupled to the feed screw to predeterminately restrain the rate of advance of the stone assembly, said restraining means including an hydraulic assembly having relatively movable piston and cylinder portions defining an expandable chamber for fluid therebetween, yieldable means urging the piston and cylinder portions to a predetermined inoperative condition, means to meter flow of fluid from the chamber to restrain relative movement between the piston and cylinder portions including adjustable needle valve means, means anchoring one of the portions of the hydraulic assembly to the honing machine, and means operatively connecting the other portion of the hydraulic assembly to the feed screw, said last named means including relatively movable cam and cam follower members one of which is operatively connected to the other portion of the hydraulic assembly and the other is engageable with the feed screw, the operator actuatable pedal means connected to simultaneously produce relative movement between the piston and cylinder portions of the hydraulic assembly and relative movement between the cam and cam follower members in opposition to the force applied by the yieldable means to establish initial conditions for commencing a honing operation, restoration of the relative movement between the cam and cam follower members during a honing operation controlling movement of the stone into engagement with the work surface and thereafter application of the restraining force produced by the hydraulic assembly against the force applied by the stone assembly against the work surface by the means to apply radial pressure thereto, said operative connection means including means adjustable to determine where in the movement of the feed screw the restraining force of the hydraulic assembly will be applied thereto.

10. The honing machine of claim 9 wherein the means adjustable to determine where in the movement of the feed screw the restraining force will be applied includes means on the honing machine for adjusting the position of the cam and cam follower members.

11. The honing machine of claim 10 wherein the means adjustable to determine where in the movement of the feed screw the restraining force will be applied include a housing for the cam and cam follower members attached to the honing machine and threaded means for adjusting the positions of the housing on the honing machine.

12. In a honing machine having a rotatable mandrel with a stone assembly mounted thereon and means to apply radial pressure to the stone assembly against a work surface during honing thereof including means to control the amount of pressure to be applied to the stone assembly by the means to apply radial pressure thereby to the work surface and means to control the amount of radial movement of the stone assembly during a honing operation, the improvement comprising means to restrain the rate of radial movement of the stone assembly against the work surface and means to control the range over which the radial movement of the stone assembly is restrained, said movement restraining means including an hydraulic dash pot assembly having relatively movable piston and cylinder portions defining therebetween a substantially closed expandable chamber for containing a fluid, yieldable means urging the piston and cylinder portions to a predetermined inoperative condition, means to meter the escape of fluid from the chamber and the rate of relative movement between the piston and cylinder portions, said metering means including a port through one of said portions and a member positionally adjustable relative thereto, means to anchor one of said dash pot portions to the honing machine, means attached to the other dash pot portion and engageable by the pressure applying means to controllably restrain application of pressure from the pressure applying means to the stone assembly, said means attached to the other dash pot portion including relatively movable cam and cam follower members one of which is operatively connected to the other dash pot portion and the other is engageable by the means for applying radial pressure to the stone assembly, and operator actuatable pedal means operatively connected to said other dash pot portion and to the cam member, operation of said operator actuatable pedal means moving the piston and cylinder portions of the dash pot assembly relative to each other in opposition to the yieldable means, and simultaneously producing relative movement between the cam and cam follower members also in opposition to the yieldable means, restoration of the cam and cam follower members under control of the yieldable means controlling movement of the stone assembly into engagement with the work surface in opposition to the means to apply radial pressure therebetween and controlling application of the restraining force of the dash pot assembly to the means to apply radial pressure to the stone assembly.

* * * * *

UNITED STATES PATENT OFFICE

CERTIFICATE OF CORRECTION

Patent No. 4,397,658 Dated August 9, 1983

Inventor(s) Frank E. Vanderwal, Jr.

It is certified that error appears in the above-identified patent and that said Letters Patent are hereby corrected as shown below:

Column 6, line 45, "coller" should be --collar--.

Column 9, line 65, "working" should be --moving--.

Signed and Sealed this

Eleventh Day of October 1983

[SEAL]

Attest:

GERALD J. MOSSINGHOFF

Attesting Officer

Commissioner of Patents and Trademarks